United States Patent [19]

Novogrodsky

[11] Patent Number: 4,616,374

[45] Date of Patent: Oct. 14, 1986

[54] MICROFLOSS TOOTHBRUSH

[76] Inventor: William Novogrodsky, 901 SW. 70th Ave., Plantation, Fla. 33317

[21] Appl. No.: 738,570

[22] Filed: May 28, 1985

Related U.S. Application Data

[62] Division of Ser. No. 511,889, Jul. 8, 1983, abandoned.

[51] Int. Cl.[4] ..... A46B 9/04

[52] U.S. Cl. ..... 15/167 R; 15/159 A; 15/209 C

[58] Field of Search ..... 15/167 R, 167 A, 104.93, 15/104.94, 110, 209 C, 210 R, 159 A

[56] References Cited

U.S. PATENT DOCUMENTS

| | | | |
|---|---|---|---|
| 2,599,191 | 6/1952 | Meunier | 15/167 R |
| 2,877,483 | 3/1959 | Alvistur | 15/167 R X |
| 3,337,893 | 8/1967 | Fine et al. | 15/167 R |
| 3,345,668 | 10/1967 | Forrest | 15/209 C |
| 4,104,435 | 8/1978 | Ballesteros | 15/209 C |
| 4,241,469 | 12/1980 | Perazzo | 15/209 C |

*Primary Examiner*—Peter Feldman

*Attorney, Agent, or Firm*—Hopgood, Calimafde, Kalil, Blaustein & Judlowe

[57] ABSTRACT

A dental toothbrush has a brush head comprised of nylon mesh or interlaced or fused loops. The brush head may be arranged in rows and in combination with ordinary, well-known bristles. By varying the design of the interlaced mesh and thickness of nylon, the rigidity of the brush head may be varied for different dental requirements.

6 Claims, 12 Drawing Figures

MICROFLOSS TOOTHBRUSH

This is a divisional of co-pending application Ser. No. 511,889 filed on July 8, 1983, now abandoned.

BACKGROUND OF THE INVENTION

The present invention relates generally to a toothbrush used to clean teeth and dental work. More particularly, it relates to a brush head of interlaced loops which upon agitatation removes foreign material from teeth or dental work.

One known method for cleaning teeth and dental work has been the use of a bristle dental brush. The conventional bristle brush employs a handle or shaft molded from a material such as polypropolyene. At one end of the shaft is a brush made of parallel nylon bristles which are positioned perpendicularly to the shaft and are secured to such shaft by known molding techniques. The conventional bristle brush has been known for many years and has changed little since its inception. The ability of the bristle brush to reach and clean the interior recesses of teeth is, however, limited.

It is an object of the invention to provide improved cleaning capabilities.

It is another object of the invention to provide an inexpensive toothbrush that will reach more surface area and recesses of a tooth than bristle toothbrushes.

A still further object of the invention is to provide an improved toothbrush capable of lifting off plaque, dirt, food and stains from teeth.

SUMMARY OF THE INVENTION

In accordance with the present invention there is provided a microfloss toothbrush having a brush head comprised of interlaced loops of nylon filaments. The interlaced loops form a mesh which when compressed against a tooth and then agitated will conform to the contour of the tooth and lift off stains and harmful plaque and food particles from the tooth surface.

Other objects and various further features of novelty and invention will be pointed out or will occur to those skilled in the art upon consideration of the following specification in conjunction with the accompanying drawings.

BRIEF DESCRIPTION OF THE DRAWINGS

The invention will be better understood after reading the following detailed description of the presently preferred embodiments thereof with reference to the appended drawings in which, for illustrative purposes only.

DESCRIPTION OF THE PREFERRED EMBODIMENTS

Figure 1:
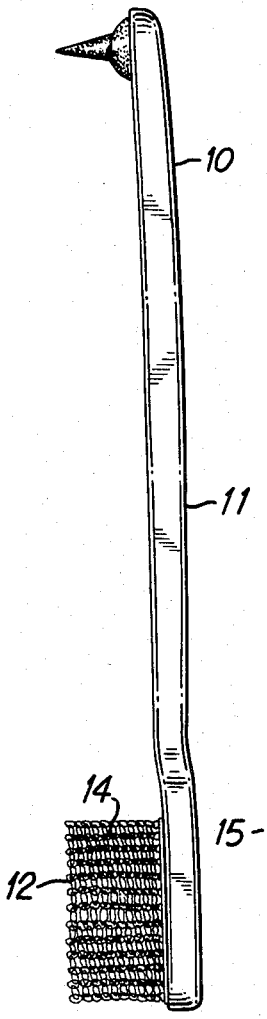
FIG. 1 is a side view showing one preferred embodiment of the toothbrush of the invention.
Figure 2:
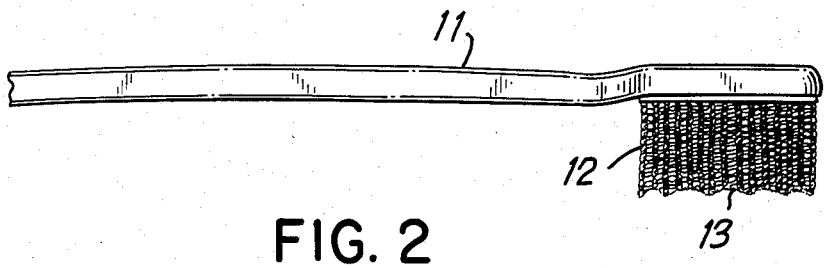
FIG. 2 is a side view of another preferred embodiment of the toothbrush in which the contour of the brush head has a scalloped design.
Figure 3:
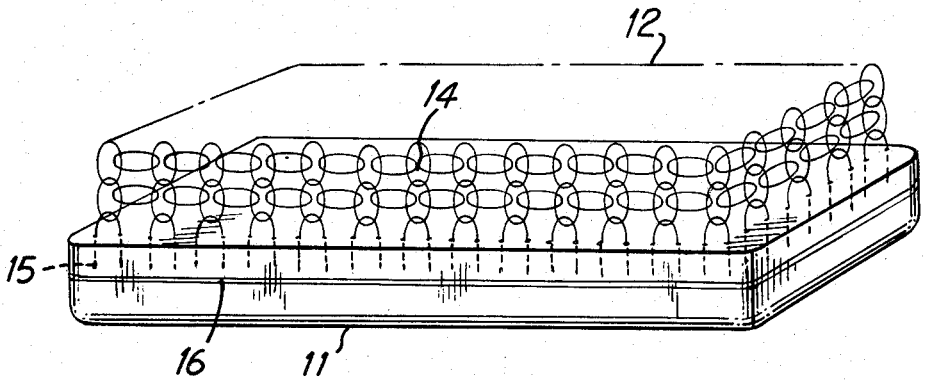
FIG. 3 is an enlarged view of one preferred embodiment of the brush head.

Reference should now be had to the drawings wherein the same reference numerals are used throughout to designate the same or similar parts. In FIG. 1 is shown a microfloss toothbrush designated generally by the reference numeral 10. The toothbrush includes a handle or shaft 11 made from a material such as polypropylene and a brush head 12 formed into an overall rectangular shape. As shown in FIG. 2, the shape of the brush head 12 may also be formed such that surface 13 opposite shaft 11 is a scallop design as may be required for particular dental requirements. In accordance with the invention, the brush heads 12 shown in the embodiment of FIGS. 1 and 2 are comprised of interlaced loops 14 of copolymer filaments such as nylon. As shown in FIG. 3, the loops 14 are interlaced both horizontally and vertically and can be built up to a desired height. The base loops 15 are bonded to a layer of material 16, which is embedded or molded into the shaft 11 to anchor the brush head 12.

The interlaced loops 14 can be constructed from filaments comprised of Tynex (TM) which is a material currently used in bristle toothbrushes and is tough and strong, and has an excellent bend and flex life. Filament diameters from 0.0025 to 0.006 inches and loop diameters from 1/32 to 1/16 inches have been found to yield satisfactory results. The filaments may also have a ribbon shape.

Known fabricating techniques are available to produce almost any weave or mesh desired. As with prior art toothbrushes, the toothbrush of the invention may be constructed with a soft, medium or hard brush head. Such characteristics are achieved by the type of copolymer selected, the diameter of the filament, and density of weave. If it is desired to clean dentures and removable bridge work, the interlaced loops or mesh may be comprised of a copolymer suitable for use with caustic solutions.

The brush head 12 may consist of copolymer loops that are randomly disoriented in a separate operation after weaving. This procedure is known as napping.

Figure 4:
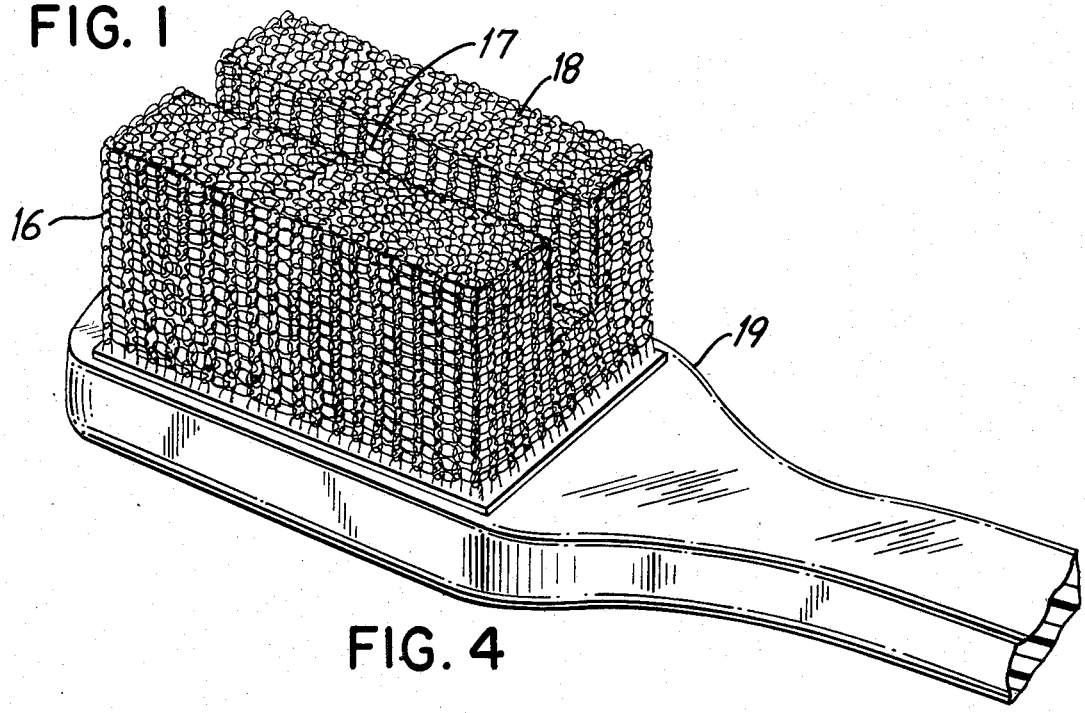
FIG. 4 is a perspective view of another preferred embodiment of the brush head.

In the embodiment of a brush head of interlaced loops shown in FIG. 4, the brush head 16 is partially cut away to form a slot 17 which, depending on design parameters, may extend from surface 18 down to a desired depth. If desired, the slot 17 may extend down to shaft 19 to form two separate hemispheres of brush head.

Figure 5:
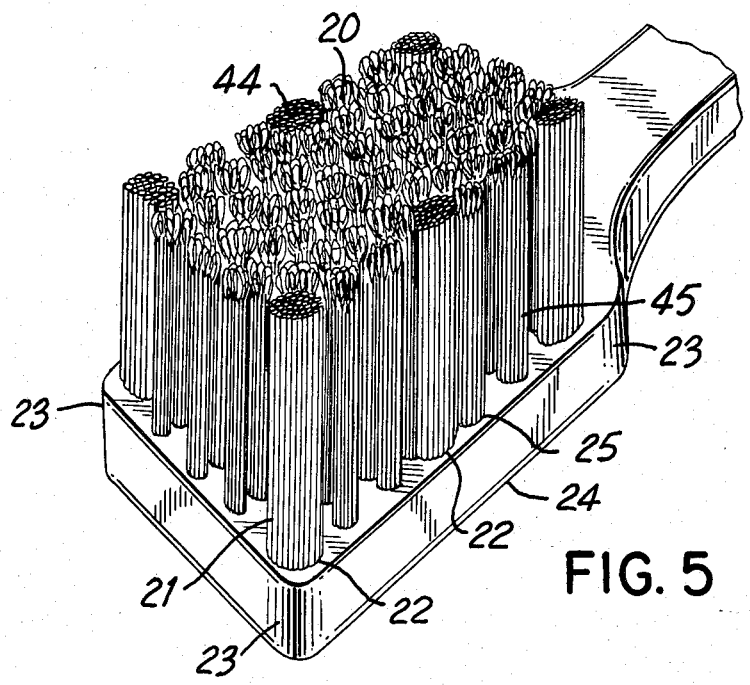
FIG. 5. is a perspective view of still another preferred embodiment of the brush head.

In the embodiment of the present invention shown in FIG. 5, interlaced loops 20 are combined with conventional parallel bristles generally designated 21. The bristles 21 are grouped in a cluster arrangement 22 and are positioned at the four corners 23 of the brush head 44. Two additional bristle clusters 22 are positioned on each longitudinal side of the brush head 44, between clusters 22 located at corners 23. Bristles 21 are positioned perpendicularly to and are embedded in shaft 24. Interlaced nylon loops 20 fill the rectangular space bound by bristle clusters 22. For greater support or rigidity, interlaced loops 20 are supported by stems 25. The stems 25 of interlaced loops 20 are embedded in or bonded to shaft 24.

Figures 6A, 6B:
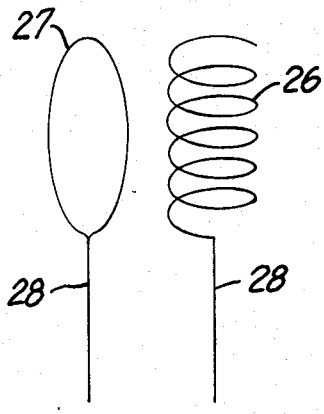
FIGS. 6A and 6B is an enlarged view of various embodiments of filaments used in other preferred embodiments of the brush head.
Figure 7A:
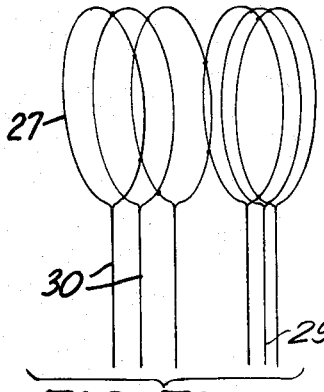
FIGS. 7A and 7B is an enlarged view of clusters formed from the individual filaments shown in FIGS. 6A and 6B.
Figure 7B:
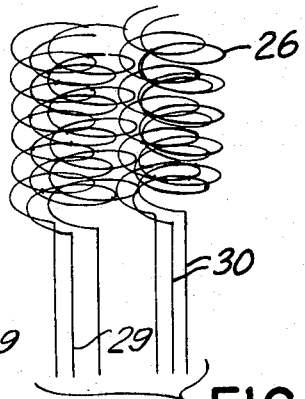
Figure 8:
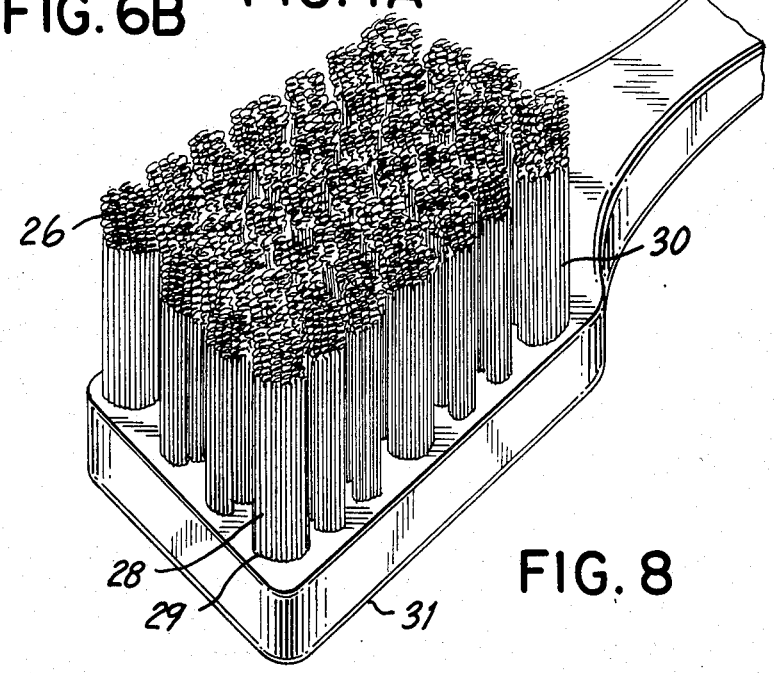
FIG. 8 is a perspective view of the brush head utilizing the filaments shown in FIGS. 6B and 7B.

In an alternative filament design shown in FIGS. 6A and 6B, instead of weaving or interlacing nylon loops, individual copolymer filaments, generally designated 28, are heated and formed into spiral loops 26 or circular loops 27. Individual filaments 28 are then grouped or compressed into clusters 29 with other filaments having spiral loops 26 or circular loops 27 to become entangled as shown in FIGS. 7A and 7B. The copolymer filaments 28 are heated to fuse the individual stems 30 together. However, the nylon should not be heated so that the copolymer melts. Tynex (TM), for example, can be fused at a temperature of 375°–380° F., but melts at 400° F. Alternatively, the spiral loops 26 or circular loops 27 may be fused or bonded together at cross-over points. Bonding may be accomplished by other known techniques such as, for example, ultrasonic bonding. The fused, entangled filaments 28 are clustered together and are embedded in shaft 31 as shown in FIG. 8.

Figure 9:
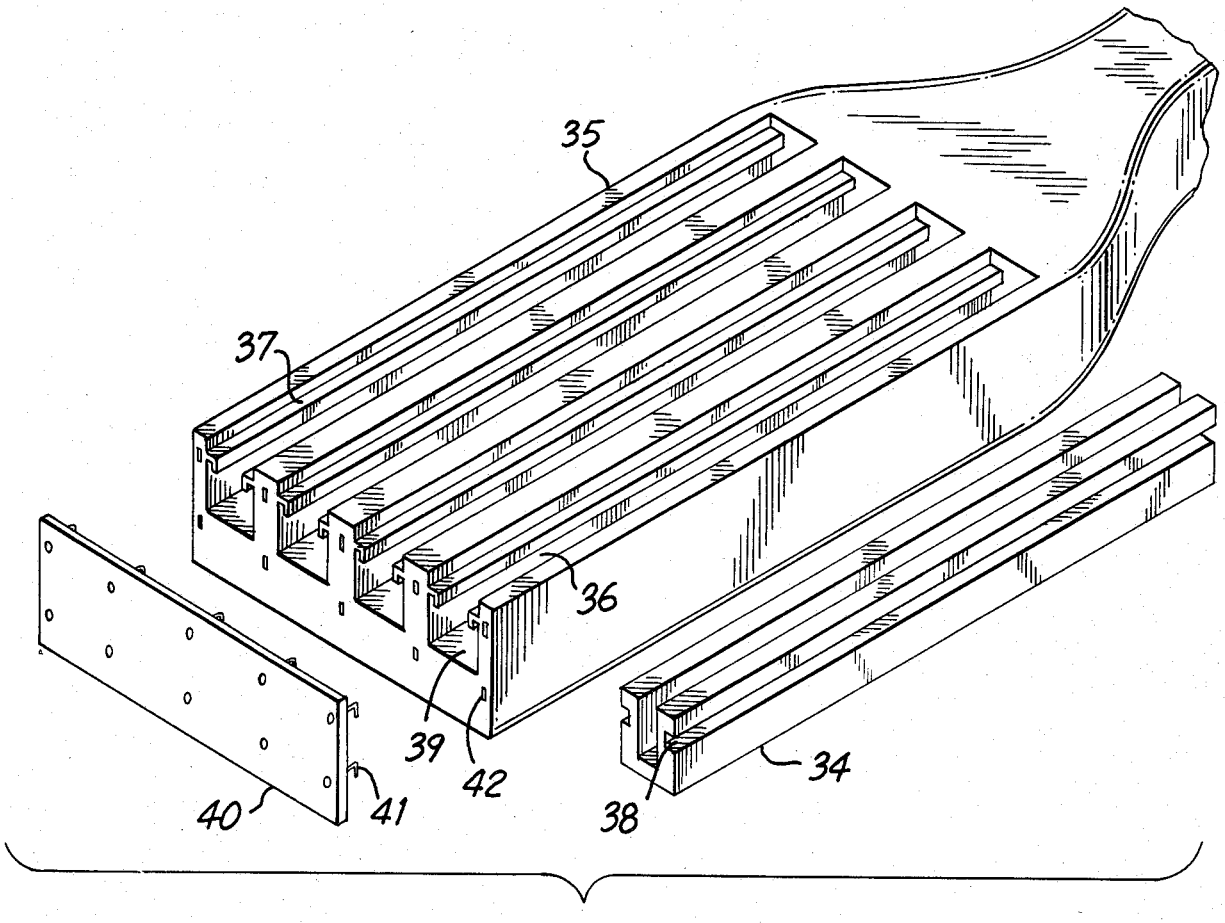
FIG. 9 is a perspective view of one preferred embodiment of the brush head with removeable inserts.
Figure 10:
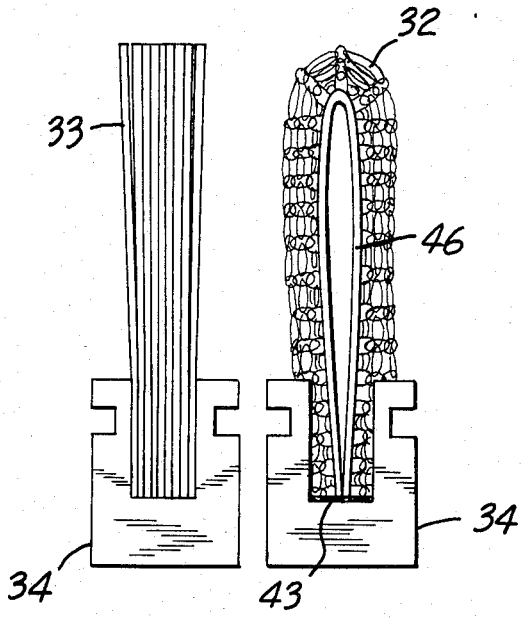
FIG. 10 is a front view of the removeable insert shown in FIG. 9.

FIGS. 9 and 10 show a brush head design in which the linear bristles 33 or copolymer loops 32, bonded to a layer of material 43, are replaceable or interchangeable. In the embodiment shown in FIGS. 9 and 10, copolymer loops 32 may also be bonded to backing material 46, folded over and placed within inserts 34 and held within said inserts by known molding, bonding or crimping techniques. Shaft 35 has channels 36 with protruding insert guides 37. Insert recesses 38 are positioned to receive protruding insert guides 37 when inserts 34 are positioned entirely within channels 36. Removeable retainer 40 is locked onto the open ends 39 of shaft 35 by clips 41, which are bonded, molded or riveted to retainer 40 Recepticles 42 receive clips 41.

The replaceable or interchangeable insert design shown in FIGS. 9 and 10 permit reuse of shaft 35 when filaments 32 are worn. Furthermore, this embodiment permits variations in filament stiffness such as soft, medium or hard, or any combination thereof.

The pliability of the brush head as in the present invention will cause it to conform to the contour of teeth, and the filaments of the brush head will reach much more surface area and recesses of teeth than prior art toothbrushes. Slight agitation of the brush head sets in motion hundreds of fibers in a whip-like action rubbing against the teeth, thereby producing improved cleaning results.

The toothbrush of the present invention will also perform the function of dental floss to remove plaque, food particles and stains from teeth. This result is achieved by the spring-like effect of the interlaced mesh. When the mesh is pressed against the teeth and agitated, the spring-like effect allows the loops to force their way between teeth spaces and under gums. Due to the pliability of the brush head, there is less wear on teeth and gums and the brush head will not harm gums or tooth enamel. The brush head can be rinsed and dried in the same manner used for a conventional bristle toothbrush.

The brush head design of interlaced, woven or fused loops may be employed with electric toothbrushes, toothbuff machines, and may be used to clean bridgework and orthondontic braces. The present invention may even be used as a peridontist brush in which the interlaced loops or mesh are anchored to twisted wire.

Having described the invention with reference to the presently preferred embodiments thereof, it will be understood that various changes may be made in the construction of the apparatus system without departing from the true spirit and scope of the invention as defined in the appended claims.

What is claimed is:

1. A microfloss dental brush head comprised of filaments perpendicularly affixed to a shaft wherein a portion of each of said filaments nearest the shaft is linear and the remaining portion of each of said filaments is circularly formed in a closed loop.

2. A microfloss dental brush head comprised of filaments perpendicularly affixed to a shaft wherein a portion of each of said filaments nearest the shaft is linear and the remaining portion of each of said filaments has a spiral form.

3. A microfloss dental brush head according to claim 1, wherein said filaments have filament cross-over points, said filaments being clustered together and said filament cross-over points being fused.

4. A microfloss dental brush head according to claim 2, wherein said filaments have filament cross-over points, said filaments being clustered together and said filament cross-over points being fused.

5. A microfloss dental brush head according to claim 1, wherein substantially linear bristles are dispersed among said filaments, said linear bristles being perpendicularly affixed to said shaft.

6. A microfloss dental brush head according to claim 2, wherein substantially linear bristles are dispersed among said filaments, said linear bristles being perpendicularly affixed to said shaft.

* * * * *